US011650525B2

(12) United States Patent
Nishida et al.

(10) Patent No.: US 11,650,525 B2
(45) Date of Patent: May 16, 2023

(54) IMAGE HEATING DEVICE AND IMAGE FORMING APPARATUS

(71) Applicant: CANON KABUSHIKI KAISHA, Tokyo (JP)

(72) Inventors: Satoshi Nishida, Kanagawa (JP); Isamu Takeda, Tokyo (JP); Takanori Mitani, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/690,491

(22) Filed: Mar. 9, 2022

(65) Prior Publication Data

US 2022/0291612 A1 Sep. 15, 2022

(30) Foreign Application Priority Data

Mar. 10, 2021 (JP) ..... JP2021-038157

(51) Int. Cl.
*G03G 15/20* (2006.01)

(52) U.S. Cl.
CPC ..... *G03G 15/2039* (2013.01)

(58) Field of Classification Search
CPC ..... G03G 15/2039
See application file for complete search history.

(56) References Cited

U.S. PATENT DOCUMENTS 5,111,014 A * 5/1992 Tanaka ..... H05B 6/062 219/664
9,471,013 B2 10/2016 Asano
2022/0365475 A1* 11/2022 Nakajima ..... G03G 15/80

FOREIGN PATENT DOCUMENTS

JP 096180 A 1/1997
JP 2010286649 A 12/2010
JP 2012118112 A 6/2012
JP 2015219366 A 12/2015

* cited by examiner

*Primary Examiner* — Clayton E. La Balle
*Assistant Examiner* — Michael A Harrison
(74) *Attorney, Agent, or Firm* — Venable LLP

(57) ABSTRACT

An image heating device includes a heater that includes a heating resistor; a rotatable tubular film in which the heater is provided in an inner space of the rotatable tubular film; a roller; and an electrification control portion configured to perform wave number control by changing the ratio of electrification ON to electrification OFF for each set control cycle. In the image heating device F1, relations tON≤τ and tOFF≤τ are satisfied, where tON represents a longest continuous electrification period in electrification patterns in which electrification is turned both on and off in the control cycle, tOFF represents a longest continuous shutoff period in the electrification patterns, and τ represents a time constant of thermal conduction with the shortest distance from the heating resistor to a contact surface of the heater that is in contact with the film.

10 Claims, 13 Drawing Sheets

| DUTY CYCLE | CONTINUOUS ENERGIZATION PERIOD (ms) | CONTINUOUS SHUTOFF PERIOD (ms) |
|---|---|---|
| 0% | 0 | 130 |
| 15% | 10 | 60 |
| 23% | 10 | 40 |
| 31% | 10 | 30 |
| 38% | 10 | 20 |
| 46% | 10 | 10 |
| 54% | 10 | 10 |
| 62% | 20 | 10 |
| 69% | 30 | 10 |
| 77% | 40 | 10 |
| 85% | 60 | 10 |
| 100% | 130 | 0 |

FIG. 11

| | TIME CONSTANT τ (msec) | LONGEST CONTINUOUS ENERGIZATION PERIOD (msec) | GLOSS NON-UNIFORMITY |
|---|---|---|---|
| EXPERIMENT APPARATUS A | 108. 3 | 60 | NO |
| EXPERIMENT APPARATUS B | 67. 0 | 60 | NO |
| EXPERIMENT APPARATUS C | 16. 2 | 60 | YES |
| EXPERIMENT APPARATUS D | 5. 0 | 60 | YES |

IMAGE HEATING DEVICE AND IMAGE FORMING APPARATUS

BACKGROUND OF THE INVENTION

Field of the Invention

The present invention relates to an image heating device, such as a fixing unit installed in an image forming apparatus such as a copier and a printer of an electrophotographic system or an electrostatic recording system, and a glossing apparatus that increases the gloss value of a toner image by reheating the toner image that has been fixed to a recording material. The present invention also relates to an image forming apparatus including this image heating device.

Description of the Related Art

Japanese Patent Application Publication No. H09-6180 discloses a conventional film-heating image heating device that is widely used as a fixing device (fixing unit) installed in an electrophotographic printer or an electrophotographic copier. Such an image heating device may use a ceramic heater as a heat source and heats a recording material and a toner image on the recording material via a thin fixing film serving as a fixing member.

The heating source of an image heating device is typically connected to an AC power supply via a switching control element, such as a triac, and receives power from this AC power supply. The image heating device includes a temperature detecting element, which detects the temperature of the image heating device. Based on the information on the detected temperature, the engine controller turns on and off the switching element to turn on and off the power supply to the heater. Temperature control is thus performed to keep the temperature of the image heating device at a fixed target temperature. The power supply to the heater is turned on and off by wave number control, phase control, or the like.

The phase control adjusts the power by changing the on/off timing (phase) of the power supply for each half wave (half cycle) of the AC voltage. The power can be adjusted with a period of not more than a half wave, enabling fine power adjustment. However, the phase control may distort the voltage waveform, creating harmonic noises and thus disturbing other circuits. A harmonic blocking circuit such as a filter is therefore required. Power control that combines phase control and wave number control may also be used, but this also requires an electric circuit in a same manner as phase control.

The wave number control (cycle control) adjusts the power by turning on and off the power supply to the heater for each half wave (half cycle) of the AC voltage and changing the on/off ratio in a set cycle. The wave number control, which does not generate harmonics, does not require a harmonic blocking circuit, advantageously reducing the cost and the size of the power control circuit as compared with the phase control.

SUMMARY OF THE INVENTION

However, since the wave number control turns on and off the power supply in units of half waves, the fluctuation of the power supply to the heater and the resulting fluctuation of the heater temperature tend to be large. The fluctuation of the heater temperature affects the toner on the recording material via the fixing film, causing non-uniformity of the degree of melting of the toner. This may cause non-uniformity of fixing, resulting in streaks of light and dark on the recording material. In particular, an image heating device, in which a fixing film of a low thermal capacity and a high thermal conductivity is used, is susceptible to temperature fluctuation due to the lower heat resistance of the fixing film, thus the increase in the likelihood of fixing non-uniformity becoming pronounced.

Additionally, the melting point and the viscoelasticity of toner are increasing lowered in recent years, resulting in a greater change in the degree of melting of toner with respect to the temperature. This increases the likelihood of causing fixing non-uniformity. In particular, when toners of multiple colors are superimposed and fixed as in a color image forming apparatus, non-uniform fixing tends to be visually perceived as gloss non-uniformity.

It is an objective of the present invention to provide an image heating device that is capable of heating without causing heating non-uniformity even when a fixing member of a high thermal conductivity and a low thermal capacity is used in wave number control, and an image forming apparatus capable of providing high-quality images without gloss non-uniformity.

To attain the above object, an image heating device of the present invention includes:

a heater that includes a heating resistor and is configured to heat an image formed on a recording material;

a rotatable tubular film in which the heater is provided in an inner space of the rotatable tubular film;

a roller forming a nip portion between the roller and the film to transport the recording material; and an electrification control portion configured to perform wave number control by changing a ratio of electrification ON to electrification OFF for each set control cycle, wherein relations $tON \leq \tau$ and $tOFF \leq \tau$ are satisfied, where tON represents a longest continuous electrification period that is a longest period in which electrification is continuously on in electrification patterns in which electrification is turned both on and off in the control cycle, tOFF represents a longest continuous shutoff period that is a longest period in which electrification is continuously off in the electrification patterns, and $\tau$ represents a time constant of thermal conduction with a shortest distance from the heating resistor to a contact surface of the heater that is in contact with the According to the present invention, an image heating device capable of heating without causing heating non-uniformity even when a fixing member of a high thermal conductivity and a low thermal capacity is used in wave number control, and an image forming apparatus capable of providing high-quality images without gloss non-uniformity are provided.

Further features of the present invention will become apparent from the following description of exemplary embodiments with reference to the attached drawings.

BRIEF DESCRIPTION OF THE DRAWINGS

FIG. 11 is a table showing the results of Experiment 1;

DESCRIPTION OF THE EMBODIMENTS

First Embodiment

Hereinafter, a description will be given, with reference to the drawings, of embodiments (examples) of the present invention. However, the sizes, materials, shapes, their relative arrangements, or the like of constituents described in the embodiments may be appropriately changed according to the configurations, various conditions, or the like of apparatuses to which the invention is applied. Therefore, the sizes, materials, shapes, their relative arrangements, or the like of the constituents described in the embodiments do not intend to limit the scope of the invention to the following embodiments. Examples of an image forming apparatus to which the present invention is applicable include a printer and a copier that use an electrophotographic system or an electrostatic recording system. An example of a laser printer is described below.

1. Image Forming Apparatus P

Figure 1:
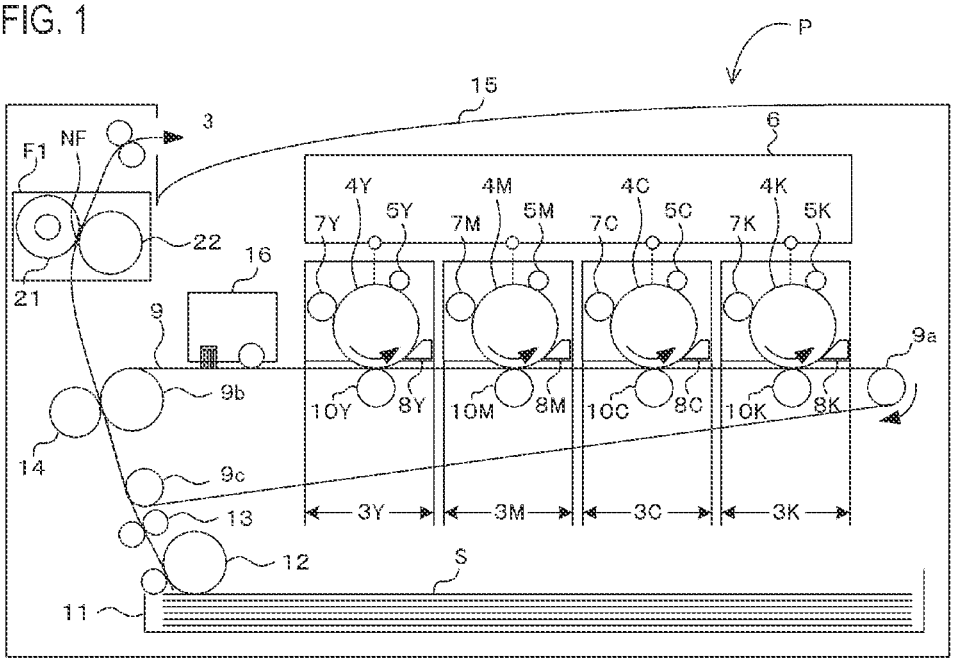
FIG. 1 is a diagram illustrating a schematic configuration of an image forming apparatus of a first embodiment.

An image forming apparatus P according to the present invention is now described. FIG. 1 is a schematic cross-sectional view of the image forming apparatus P of the present embodiment that uses an electrophotographic recording technique, The image forming apparatus P includes four image forming stations 3Y, 3M, 3C, and 3K arranged substantially linearly. The thur image forming stations 3Y, 3M, 3C, and 3K form images of yellow (hereinafter abbreviated as Y) color, magenta M (hereinafter abbreviated as M) color, cyan (hereinafter abbreviated as C) color, and black (hereinafter abbreviated as K) color, respectively. Each image forming station 3Y, 3M, 3C, 3K has a photosensitive drum 4Y, 4M, 4C, 4K as an image bearing member, and a charging roller 5Y, 5M, 5C, 5K as a charging means. Each image forming station 3Y, 3M, 3C, 3K also includes an exposure apparatus 6 as an exposure means, a developing apparatus 7Y, 7M, 7C, 7K as a developing means, and a cleaning apparatus 8Y, 8M, 8C, 8K as a cleaning means.

An image forming operation starts when image information is received. In the image forming operation, a rotation control portion (driving control means) (not shown) rotates, in response to a print instruction, the photosensitive drum 4Y of the image forming station 3Y in the direction of an arrow in FIG. 1. First, the charging roller 5Y uniformly charges the outer circumferential surface (surface) of the photosensitive drum 4Y, and the exposure apparatus 6 applies laser light to the charged surface of the photosensitive drum 4Y for exposure according to the image data, thereby forming an electrostatic latent image. The latent image is visualized by the developing apparatus 7Y using Y toner and becomes a Y toner image. A Y toner image is thus formed on the surface of the photosensitive drum 4Y. The same image forming process is performed at the image forming stations 3M, 3C, and 3K, so that an M toner image is formed on the surface of the photosensitive drum 4M, a C toner image is formed on the surface of the photosensitive drum 4C, and a K toner image is formed on the surface of the photosensitive drum 4K.

An intermediate transfer belt 9 extends in the arrangement direction of the image forming stations 3Y, 3M, 3C, and 3K and is stretched over a driver roller 9*a*, a driven roller 9*b*, and a driven roller 9*c*. The rotation control portion (driving control means) (not shown) rotates, in response to a print instruction, the driver roller 9*a* in the direction of an arrow in FIG. 1. The intermediate transfer belt 9 is thus rotated and moved along the image forming stations 3Y, 3M, 3C, and 3K at a predetermined process speed. Primary transfer rollers 10Y, 10M, 10C, and 10K arranged opposite to the photosensitive drums 4Y, 4M, 4C, and 4K with the intermediate transfer belt 9 sandwiched in between sequentially transfer and superimpose the toner images of the respective colors on the outer circumferential surface (surface) of the intermediate transfer belt 9. A full-color toner image of four colors is thus formed on the surface of the intermediate transfer belt 9.

The transfer residual toner remaining on the surface of each photosensitive drum 4Y, 4M, 4C, 4K after the primary transfer is removed by a cleaning blade (not shown) provided in the cleaning apparatus 8Y, 8M, 8C, 8K. This allows the photosensitive drums 4Y, 4M, 4C, and 4K to prepare for the next image formation. The above-mentioned photosensitive drums 4, the charging rollers 5, the developing apparatuses 7, the primary transfer rollers 10, and a scanner unit (not shown) constitute an image forming portion that forms an unfixed image on the recording material S.

The recording materials S stacked in a feeding cassette 11 located in the lower part of the image forming apparatus P are separately fed from the feeding cassette 11 one by one by a feeding roller 12 and transported to a resist roller pair 13. The resist roller pair 13 sends the fed recording material S to a transfer nip portion between the intermediate transfer belt 9 and a secondary transfer roller 14. The secondary transfer roller 14 is arranged so as to face the driven roller 9*b* with the intermediate transfer belt 9 sandwiched in between. Then, a bias is applied to the secondary transfer roller 14 from a high voltage power source (not shown) when the recording material S passes through the transfer nip portion. As a result, a full-color toner image is secondary-transferred from the surface of the intermediate transfer belt 9 to the recording material S passing through the transfer nip portion. The recording material S carrying the toner is transported to a fixing device F1. Then, the recording material S is heated by the heat of a heater in the fixing device F1, which serves as a fixing portion (image heating portion), and pressurized, so that the toner image is thermally fixed on the recording material S. The recording material S is then discharged from the fixing device F1 to a discharge tray 15 outside the image forming apparatus P by paper discharge rollers. The transfer residual toner remaining on the surface of the intermediate transfer belt 9 after the secondary transfer is removed by an intermediate transfer belt cleaning apparatus 16. This allows the intermediate transfer belt 9 to prepare for the next image formation.

The above-mentioned image forming apparatus is an example of a color laser printer of a tandem system or the like that forms an image by transferring color toners of at least two colors to a recording material via the intermediate transfer belt. However, the present invention is not limited to this application, and is also applicable to a monochrome laser printer using monochrome toner of a single color.

2. Fixing Device F1

The fixing device F1, which serves as an image heating device and a means for fixing toner images, is now described. In the following description, as for the fixing device and the members forming the fixing device, a longitudinal direction is a direction perpendicular to the direction in which a recording material is transported on the plane of the recording material, and a transverse direction is a direction parallel to the transport direction of the recording material on the plane of the recording material. As for the recording material, the longitudinal width refers to the dimension in a direction perpendicular to the recording material transport direction on the plane of the recording material.

Figure 2:
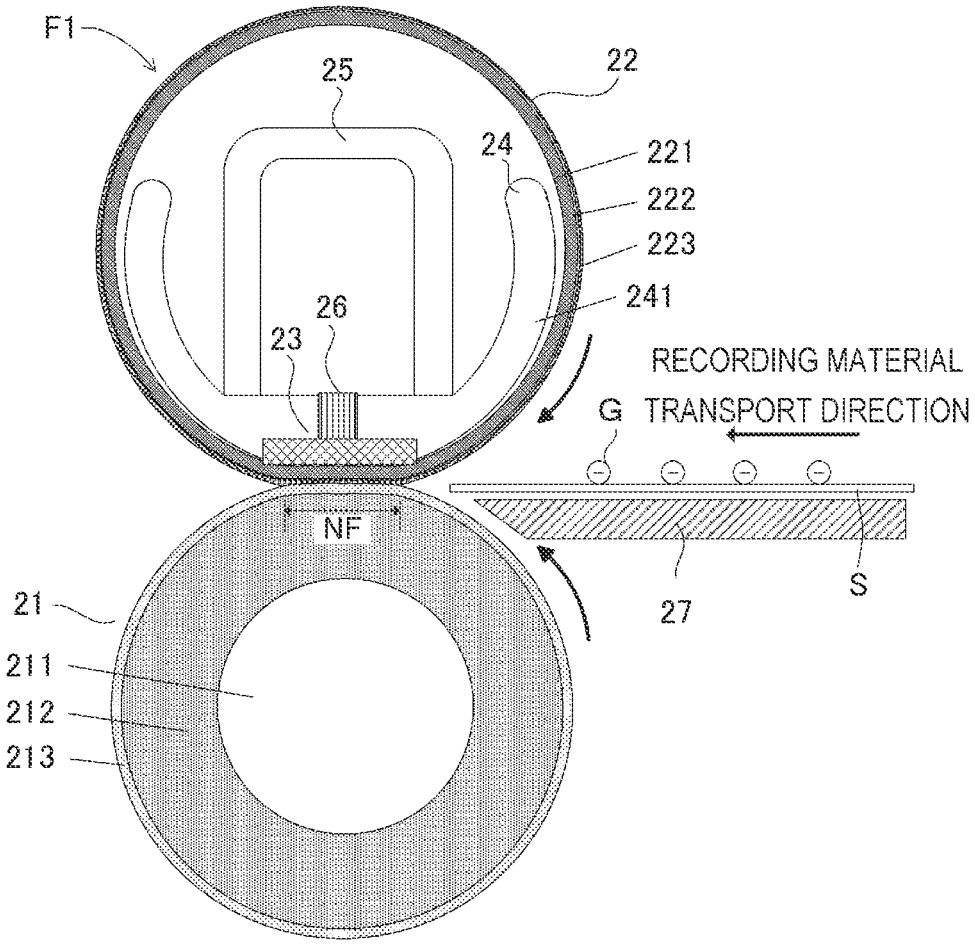
FIG. 2 is a diagram illustrating a schematic configuration of a fixing device of the first embodiment.

FIG. 2 is a schematic cross-sectional view of the fixing device F1. The fixing device F1 of the present embodiment is an apparatus of a film heating system and a pressing roller driving system, which is also called a tension-free apparatus, and includes a pressing roller 21, a fixing film 22, a heater 23, a heater holder 24, and a rigid stay 25. The pressing roller 21, the fixing film 22, the heater 23, the heater holder 24, and the rigid stay 25 are all elongated members extending in the longitudinal direction.

The pressing roller 21 as a pressing rotation member is arranged below the fixing film 22 in parallel with the fixing film 22, and includes a core metal 211, which is rotationally held by bearing members (not shown) at opposite longitudinal ends.

Pressing springs (not shown) presses the longitudinal ends of the core metal 211 of the pressing roller 21 and the rigid stay 25 so that the outer circumferential surface (surface) of the pressing roller 21 is in contact with the outer circumferential surface (surface) of the fixing film 22. The pressing force brings the surfaces of the pressing roller 21 and the fixing film 22 into contact with each other, forming a nip portion NF in between, which has a predetermined width and sandwiches and transports the recording material S.

The heater holder 24, which is made of a heat-resistant resin such as liquid crystal polymer, holds the heater 23. The heater holder 24 includes a guide portion 241 and functions to guide the rotation of the fixing film 22.

In response to a print instruction, the rotation control portion (driving control means) (not shown) rotates the pressing roller 21 in the direction of an arrow in FIG. 2 at a process speed. The rotatable fixing film 22 is driven and rotated by the pressing roller 21 along the outer circumference of the heater holder 24 in the direction of an arrow in FIG. 2. When rotated, the inner circumference surface of the fixing film 22 slides on and in close contact with the heater 23 in the fixing nip portion NF.

A recording material S carrying an unfixed toner image G is fed to the fixing nip portion NF through an inlet guide 27 and is sandwiched and transported by the pressing roller 21 and the fixing film 22. In this transport process, the fixing film 22 applies heat and pressure to the recording material S, thermally fixing the unfixed toner image G on the surface of the recording material S.

2-1. Fixing Film 22

The fixing film 22 has a cylindrical base layer 221 and a releasing layer 222 on the outer side of the base layer 221. The base layer 221 is made mainly of a heat-resistant material with flexibility. Examples of flexible heat-resistant materials include a heat-resistant resin, such as polyimide, polyamide-imide, PEEK, PES, or PPS, and a metal, such as stainless steel (SUS) or nickel. The releasing layer 222 on the outer circumference of the base layer 221 may be made of fluorine resin and provide non-adhesiveness with respect to toner. An intermediate layer for bonding the layers may be provided between the base layer 221 and the releasing layer 222 if necessary, but the material and thickness of the intermediate layer should not significantly hinder the overall thermal conduction of the fixing film 22.

To efficiently conduct the heat of the heater 23 to the toner image on the recording paper, the fixing film 22 is preferably a thin layer and has a low thermal capacity. The overall thickness of the fixing film 22 is preferably not more than 160 μm, more preferably not more than 100 μm.

In the present embodiment, the fixing film 22 has a two-layer configuration of the base layer 221, which has a thickness of 50 μm and is mainly made of polyimide, and the releasing layer 222, which has a thickness of 15 μm, is made of fluorocarbon resin, and has high releasability. The fixing film 22 has an outer circumference length of 57 mm. A common configuration may include a heat-resistant elastic layer of silicone rubber or other material between the base layer and the releasing layer, but the present embodiment does not include such a layer to conduct the heat of the heater 23 more efficiently.

2-2. Pressing Roller 21

The pressing roller 21 has a core metal 211, which has the shape of a round shaft, an elastic layer 212, which is made of silicone libber and formed on the outer circumference of the core metal 211 to be concentric and integral with the core metal 211, and a releasing layer 213, which is formed around the elastic layer 212 and made of a conductive fluorocarbon resin. The pressing roller 21 has an outer circumference length of 63 mm. The elastic layer 212 may be made of heat-resistant rubber such as fluorocarbon rubber, or it may be formed by foaming silicone rubber. The releasing layer 213 may be made of an insulating fluorine resin.

2-3. Heater

Figure 3:
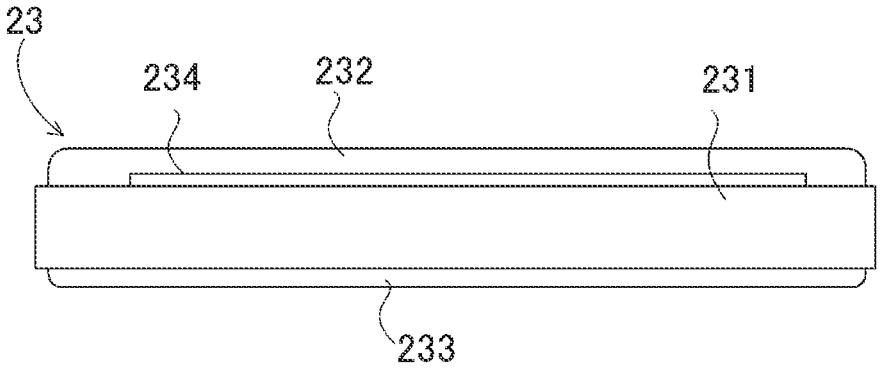
FIG. 3 is a diagram illustrating a schematic configuration of a heater of the first embodiment.

FIG. 3 is a schematic cross-sectional view of the heater 23 of the present embodiment. The heater 23 of the present embodiment includes an elongated substrate 231, which extends in the longitudinal direction, and a heating element 234, which is a heating resistor extending in the longitudinal direction of the substrate 231 on the surface of the substrate 231 that is opposite to the contact surface in contact with the fixing film 22.

The heater 23 of the present embodiment includes feeding electrodes (not shown) for feeding power to the heating element 234 in opposite longitudinal end sections of the substrate 231. The heater 23 also includes a heat-resistant protective coat layer 232, which covers the heating element 234, and a sliding coat layer 233, on which the fixing 22 slides. The sliding coat layer 233 of the heater 23 is in contact with the inner surface of the fixing film 22 directly or through grease or the like. The heater 23 is formed as an indivisible integral component from the protective coat layer 232 to the sliding coat layer 233.

The substrate 231 is an elongated plate-shaped member made of a heat conductive material such as alumina (aluminum oxide), aluminum nitride, or a metal coated with an insulating member. In the present embodiment, the substrate 231 is an elongated member made of alumina (aluminum oxide) and has a thickness of 1 mm.

The protective coat layer 232 is made of a heat-resistant material, which may be glass or a resin, such as polyimide or fluorocarbon resin, protects the heating element 234, and provides insulation and pressure resistance. In the present embodiment, the protective coat layer 232 is made of glass and has a thickness of 60 μm.

The sliding coat layer 233 is made of glass or a resin, such as polyimide or fluorocarbon resin, and provides slidability and wear resistance with respect to the inner surface of the fixing film 22. In the present embodiment, the sliding coat layer 233 is made of glass and has a thickness of 30 μm.

The heat from the heating element 234 arranged on the substrate 231 is conducted to the heater surface in contact with the fixing film 22 via the substrate 231 and the sliding coat layer 233. The heating element 234 is formed by applying an electric resistance material, such as silver or palladium, with a thickness of about several tens of μm by screen deposition or other technique. Hereinafter, the surface including the sliding coat layer 233 in contact with the fixing film of the heater 23 is referred to as the front surface, and the surface including the protective coat layer 232 on the opposite side is referred to as the back surface.

The temperature of the heater 23 is kept at a predetermined temperature by controlling the electrification of the heating element 234. However, there is a delay between the time when the heating element 234 is energized and starts to generate heat and the time when a certain temperature change occurs at the surface of the heater 23. The degree of delay in this temperature transmission is represented by a time constant τ. When the temperature of the heating element 234 is changed from T1 to T2, the following relation holds between the elapsed time τ and the surface temperature Ts of the heater 23.

$$Ts=(T2-T1)\ \{1-\exp(-t/\tau)\}+T1 \qquad \text{[Math. 1]}$$

This constant τ is referred to as a time constant. Based on the expression, the time constant τ is the time required for the surface temperature Ts of the heater 23 to change from the initial temperature to 63.2% of the final achieving temperature when the temperature of the heating element 234 is suddenly changed from T1 to T2. Also, the time constant τ depends on the thermal conductivity, the thermal capacity, and the thickness of the interposed member, and is obtained by the following expression.

$$\text{Time constant } \tau\ [\text{sec}]=\text{Thickness } d[\text{m}]/\text{Thermal conductivity } \lambda\ [W/(m\cdot K)]\times\text{Thermal capacity C per unit area } [J/(K\cdot m\hat{}2)] \qquad \text{[Math. 2]}$$

When a plurality of members is interposed, the sum of the time constants τ of these interposed members is used. That is, the time constant τ is proportional to the thickness and thermal capacity of the interposed member and inversely proportional to the thermal conductivity. As such, the time constant τ is greater and the temperature change is slower when the interposed member has a lower thermal conductivity, a greater thermal capacity, and a greater thickness.

When the time constant τ of the heater 23 is excessively large, the fixing device F1 requires greater energy and a longer time to start up, compromising energy saving and user convenience. When the time constant τ of the heater 23 is excessively small, the fluctuations of the power and the temperature of the heating element 234 tend to cause fluctuations of the surface temperature of the heater 23, increasing the possibility of melting non-uniformity in the heating and fixing of a recording material and the toner on the recording material. Accordingly, the heater 23 is preferably configured to have a time constant τ of at least 50 msec and less than 200 msec.

The time constant τ in the present embodiment is calculated as follows. The substrate 231 is made of alumina and has a thickness of 1 mm. Alumina has a thermal conductivity of 25.6 W/mK and a thermal capacity per unit area of 2700 J/(K·m^2). Thus, according to the above expression, the time constant of thermal conduction with the shortest distance from the back surface to the front surface of the substrate 231 is 105.5 msec.

The sliding coat layer 233 is made of glass and has a thickness of 30 μm Glass has a thermal conductivity of 1.4 W/(m·K) and a thermal capacity per unit area of 140 J/(K·m^2). Thus, the time constant of thermal conduction with the shortest distance from the back surface to the front surface of the sliding coat layer 233 is 3.0 msec. The time constant τ from the heating element 234 to the front surface of the heater 23 is 108.5 msec in total.

2-4 Drive Circuit

Figure 4:
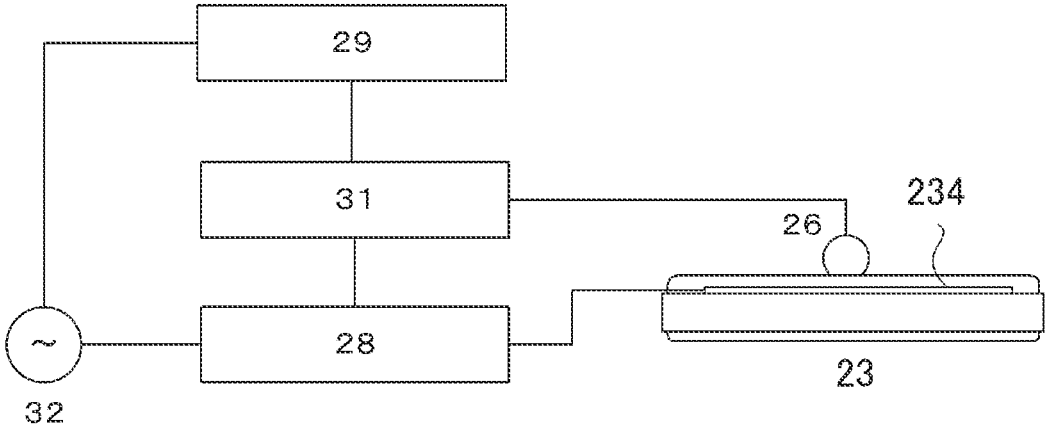
FIG. 4 is a diagram illustrating a schematic configuration of the heater and a drive circuit of the first embodiment.

FIG. 4 is a schematic diagram showing an outline of the heater 23 and the drive circuit. The commercial AC power supply 32 is an AC power supply to which the image forming apparatus is connected. As shown in FIG. 4, the image forming apparatus feeds the commercial AC power supply 32 to the heater 23 via the triac 28 to heat the heating element 234 of the heater 23. The supply of electric power to the heater 23 is controlled by performing electrification and shutoff on the triac 28 serving as a power supply means.

A zero-cross detection circuit 29 detects the zero-cross point (point at which the voltage is switched between positive and negative) of the commercial AC power supply 32, and notifies a control means 31 serving as an electrification control portion. The control means 31 uses the zero-cross signal as a trigger to switch the triac 28 on and off by wave number control. That is, the triac 28 operates in response to a signal from the control means 31 to control the power supply to the heater 23.

The temperature of the heater 23 is detected by a thermistor 26, which serves as a temperature detecting means provided on the back surface of the heater 23. The control means 31 monitors the temperature detected by the thermistor 26 and compares it with the preset temperature of the heater 23 that is set in the control means 31 to calculate the power to be supplied to the heater 23. The control means 31 sends an ON signal to the triac 28 according to the control condition using the electrification pattern corresponding to the calculated power supply. The control circuit as described above maintains the heater 23 at a predetermined temperature. For example, in normal fixing mode, the temperature is maintained at 190° C.

3. Wave Number Control

Figure 5:
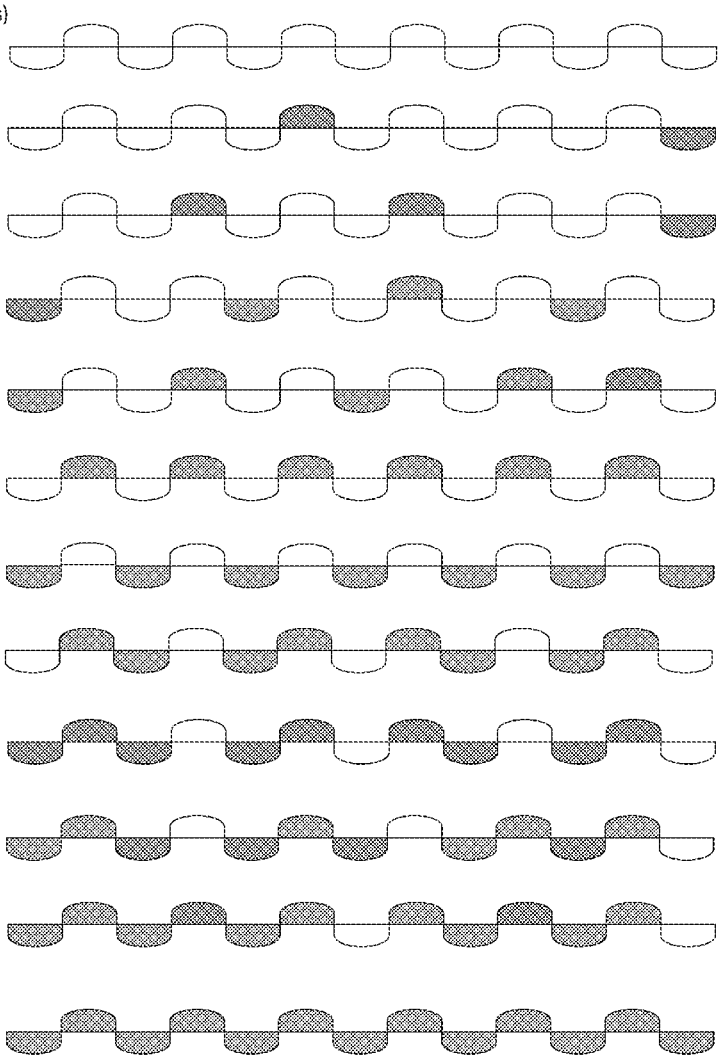
FIG. 5 is a diagram illustrating electrification patterns in wave number control of the first embodiment.

FIG. 5 shows an example of the electrification patterns of the wave number control of the present embodiment. Using a control cycle of 13 half waves (for example, with a commercial power supply of 50 Hz, one half wave is 10 msec, and one cycle is 130 msec), the power is switched on and off for 13 half waves according to the electrification patterns shown in FIG. 5 to adjust the power in multiple stages. For example, to set the percentage (duty cycle) to 46% with respect to 100% power supply input, six half waves of 13 half waves are ON, and the seven half waves are OFF. In wave number control, the average power of a control cycle of 130 msec is the desired power, but the electrification is either ON or OFF for each half wave, so that the supplied power is momentarily excessively large or excessively small. For example, with an electrification pattern having a duty cycle of 46%, even though the average power of the 13 half waves is the duty cycle of 46%, the duty cycle is momentarily either 100% or 0%.

In the wave number control with 60 Hz commercial power supply, the power is turned on or off at intervals of at least 10 msec. When the process speed is 100 mm/sec, 10 msec corresponds to 1 mm of the moving distance of the surface of the fixing film and the recording material during a fixing operation. This length increases when the power is turned on over a plurality of half waves. For example, When the power is on for successive five half waves, the length will be 50 msec, which corresponds to 5 mm.

As described above, the wave number control tends to cause temperature fluctuations in which the temperature of the heater 23 becomes excessively high or excessively low. As such, when the fixing device F1 has a fixing film of a thin layer as in the present embodiment, the fluctuations of the surface temperature of the heater 23 during thermal fixing may cause the melting non-uniformity of the toner image G on the paper. The melting non-uniformity of the toner after thermal fixing may be visually perceived as gloss non-uniformity of the fixed image causing an image defect.

4. Heater Time Constant and Continuous Energization Period of Power Control

The fixing device F1 of the present embodiment is characterized in that the time constant τ of the heater 23, the longest continuous electrification period tON, and the longest continuous shutoff period tOFF in the electrification patterns of power supply, which will be described below, satisfy the thllowing relations.

Longest continuous electrification period tON≤time constant τ of heater 23

Longest continuous shutoff period tOFF≤time constant τ of heater 23

In a control cycle of wave number control, a period in which electrification is continuously on is referred to as a continuous electrification period, and the period in which electrification is continuously off is referred to as a continuous shutoff period. In electrification patterns excluding an electrification pattern with a duty cycle of 100% (all ON) or 0% (all OFF), in which electrification is not switched between on and off, the longest of these periods are referred to as a longest continuous electrification period tON and a longest continuous shutoff period tOFF. For example, of the electrification patterns shown in FIG. 5, a continuous electrification period in the electrification pattern with a duty cycle of 85% lasts for successive six half waves and is thus the longest. The longest continuous electrification period tON is therefore 60 msec. A continuous shutoff period in the electrification pattern with a duty cycle of 15% lasts for successive six half waves and is thus the longest. The longest continuous shutoff period tOFF is therefore 60 msec. As described above, since the time constant τ from the heating element 234 to the front surface of the heater 23 in the present embodiment is 108.5 msec, the above relations are satisfied.

Figure 6:
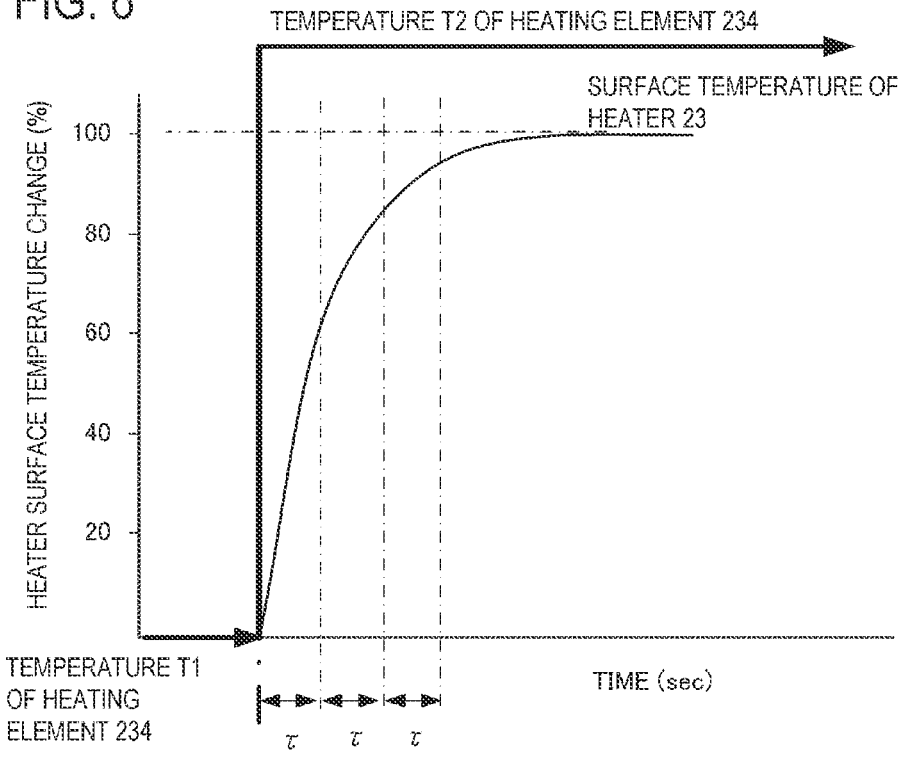
FIG. 6 is a graph showing changes in the heater surface temperature occurring when the heater is heated.

The advantages of the present embodiment are now described. FIG. 6 shows changes in the surface temperature of the heater 23 occurring when the temperature of the heating element 234 is suddenly changed from T1 to T2. When the temperature of the heating element 234 is changed, the surface temperature of the heater 23 changes with a delay according to the time constant τ of the heater 23. When the temperature of the heating element 234 is changed, the surface temperature of the heater 23 becomes 63.2% of the final achieving temperature after time τ, 86.5% of the final achieving temperature after time 2 τ, and 95.0% of the final achieving temperature after time 3 τ.

Figure 7:
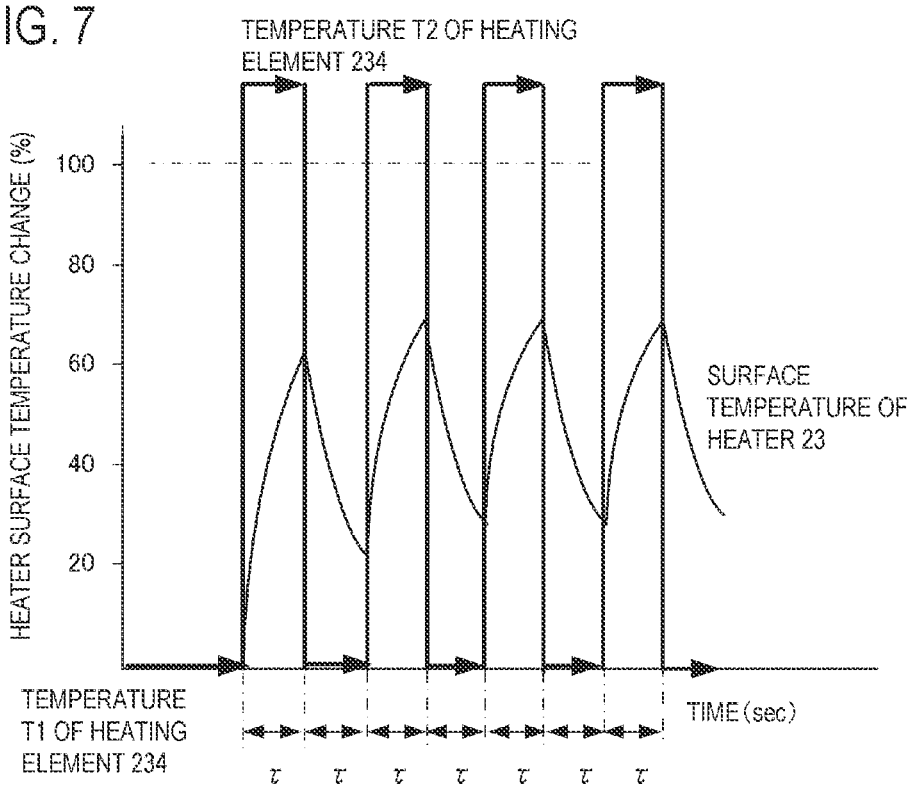
FIG. 7 is a graph showing changes in the heater surface temperature with switching cycles τ.

FIG. 7 shows changes in the surface temperature of the heater 23 occurring when the temperature of the heating element 234 is periodically switched between T1 and T2 in a cycle of τ. When the temperature of the heating element 234 is switched from T2 to T1, the surface temperature of the heater 23 also changes with a delay according to the time constant τ of the heater 23. When the temperature of the heating element 234 is switched every time constant τ, the temperature of the heating element 234 is switched before the surface temperature of the heater 23 changes significantly, reducing the amplitude of the surface temperature of the heater 23.

Figure 8:
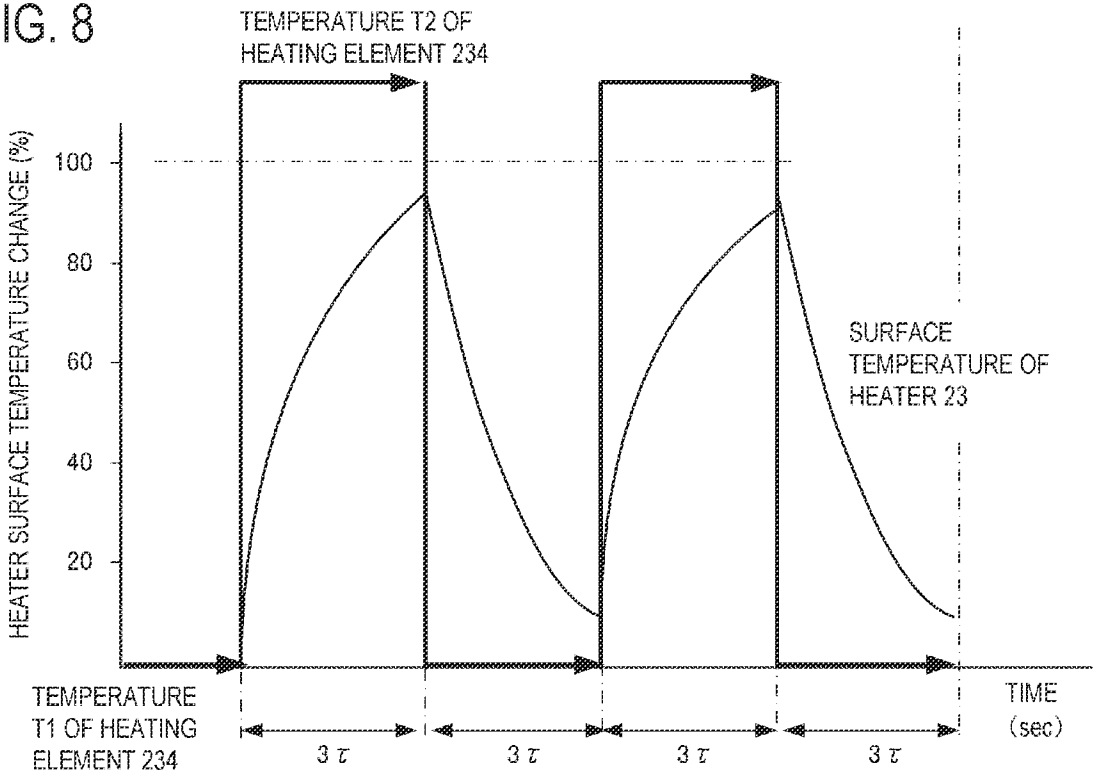
FIG. 8 is a graph showing changes in the heater surface temperature with switching cycles 3 τ.

FIG. 8 shows changes in the surface temperature of the heater 23 occurring when the temperature of the heating element 234 is periodically switched between T and T2 in a cycle of 3 τ. When the temperature switching time of the heating element 234 is long, the surface temperature of the heater 23 changes significantly, increasing the amplitude of the surface temperature of the heater 23.

Figure 9:
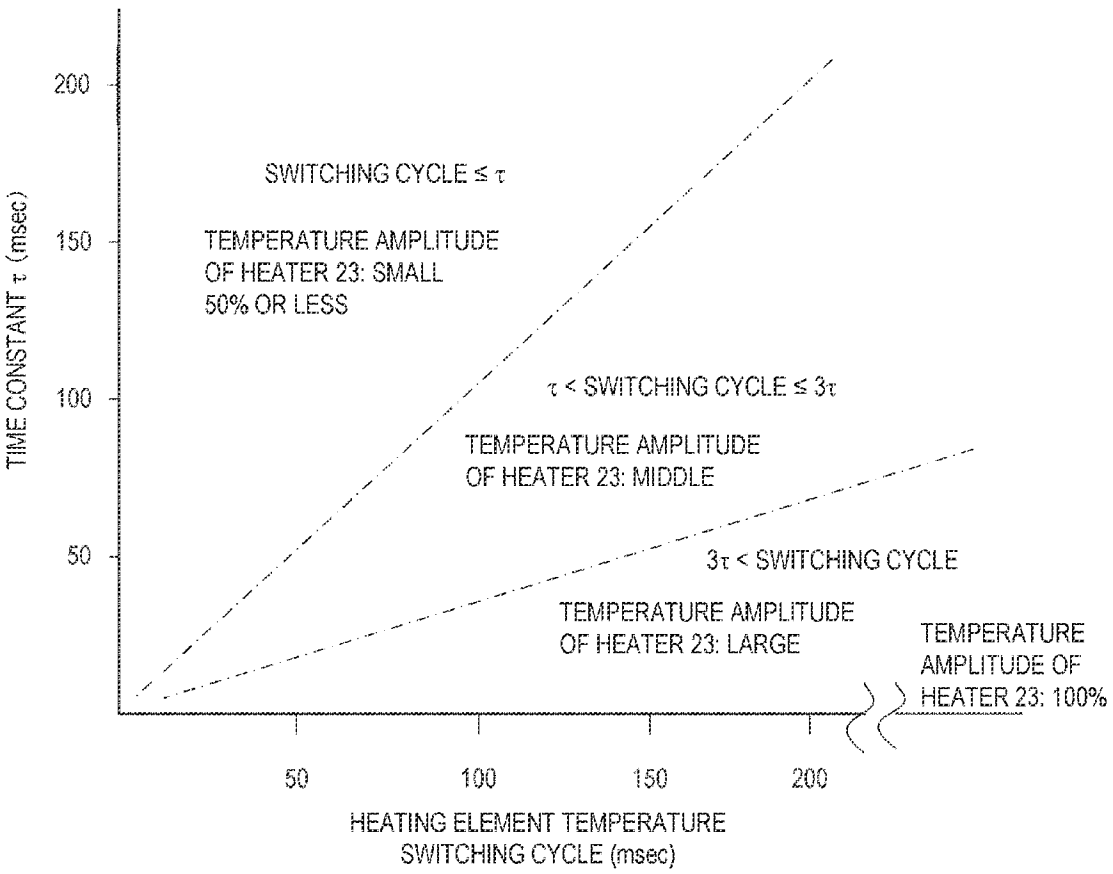
FIG. 9 is a graph showing the relationship of the time constant, the switching cycle, and the amplitude of the heater surface temperature.

FIG. 9 is a graph showing the relationship of the temperature switching cycle of the heating element 234, the time constant τ of the heater 23, and the amplitude of the surface temperature of the heater 23 in a state in which the temperature of the heating element 234 is periodically switched. In the graph of FIG. 9, the vertical axis indicates the time constant τ, and the horizontal axis indicates the temperature switching cycle of the heating element 234. The amplitude obtained when the temperature switching cycle of the heating element 234 is sufficiently long and the surface temperature of the heater 23 reaches the final achieving temperature is defined as 100%. The amplitude of the surface temperature of the heater 23 can be reduced by reducing the temperature switching cycle of the heating element 234 relative to the time constant τ of the heater 23.

In the model described above, the temperature of the heating element 234 is instantaneously switched between T1 and T2. The heating element 234 has a sufficiently small thermal capacity and quickly changes its temperature in response to electrification. As such, switching the electrification between on and off is expected to achieve the same advantageous effect as switching the temperature. That is, the change in the surface temperature of the heater 23 can be reduced by reducing the intervals between switching the electrification of the heating element 234 from on to off and from off to on, relative to the time constant τ of the heater 23.

In other words, as long as the longest continuous electrification period tON and the longest continuous shutoff period tOFF are not more than the time constant τ of the heater 23, the non-uniformity and the amplitude of the surface temperature of the heater 23 can be reduced with any electrification patterns. Accordingly, regardless of the configuration, the thermal capacity, or the thermal conductivity of the fixing film 22, the melting non-uniformity and gloss non-uniformity of the toner on paper can be reduced, allowing for the obtainment of satisfactory images.

5. Experiment

Experiment was conducted to confirm the effects of the image forming apparatus and the fixing device of the present embodiment. The process speed of each image forming apparatus used in the experiment was 100 mm/s, and the distance between a recording material S and the subsequent recording material S (paper distance) was 30 mm. The experiment was conducted with the image forming apparatus placed in an environment of an ambient temperature of 23° C. and a humidity of 50%. The experiment used general LBP printing paper of a basis weight of 80 g/m^2 and letter size (216 mm in width and 279 mm in length).

The image used for the evaluation was a solid image with 5 mm margins at the top, bottom, right, and left edges of the page as margin sections. Toners of two colors, M toner and C toner, were superimposed over the entire page so as to obtain an image density of 200% in total.

Image formation and fixing operation were performed, and the image after the fixing operation was visually checked to evaluate gloss non-uniformity. Experiment was conducted using a plurality of experimental apparatuses that differ in the time constant τ of the heater 23 of the fixing devices F1 and by setting the longest continuous electrification period tON and the longest continuous shutoff period tOFF to the same value (60 msec).

Experiment Apparatus A includes an image forming apparatus and a fixing device F1 of the present embodiment. The time constant τ of the heater 23 is 108.3 msec as described above. In accordance with the difference between the current temperature and the target control temperature, the power control is performed using the electrification patterns of the present embodiment. The maximum power supply to the heater with a commercial power supply of 120 V/60 Hz is 700 W. The longest continuous electrification period tON and the longest continuous shutoff period tOFF in wave number control are 60 msec. These longest continuous electrification period ION and the longest continuous shutoff period tOFF are 0.55 times the time constant τ and sufficiently small.

Experiment Apparatus B is Comparison Example 1 and includes an image forming apparatus and a fixing device F1 in which the thickness of the substrate 231 differs from that of the present embodiment. The basic configuration of the fixing device F1 and the heater 23 of Experiment Apparatus B is the same as the present embodiment except for the substrate 231 that is made of alumina and has a thickness of 0.635 mm. The time constant of this substrate 231 is 67.0 msec. The sliding coat layer 233 is made of glass and has a thickness of 30 μm. The thermal conductivity is 1.4 W/(m·K), the thermal capacity per unit area is 140 J/(K·m^2), and the time constant from the back to the front of the sliding coal layer 233 is 3.0 msec. Accordingly, the time constant τ from the heating element 234 to the front surface of the heater 23 is 70.0 msec in total. The wave number control is the same as that of the present embodiment, and the longest continuous electrification period tON and the longest continuous shutoff period tOFF are 60 msec. The longest continuous electrification period tON and the longest continuous shutoff period tOFF are less than the time constant τ and 0.86 times the time constant τ.

Experiment Apparatus C is Comparison Example 2 and includes an image forming apparatus and a fixing device F1 in which the material and thickness of the substrate 231 differ from those of the present embodiment. The basic configuration of the fixing device F1 and the heater 23 of Experiment Apparatus C is the same as the present embodiment except for the substrate 231 that is made of aluminum nitride and has a thickness of 0.6 mm. The thermal conductivity of aluminum nitride is 65.7 W/(m·K), the thermal capacity per unit area is 1200 J/(K·m^2), and the time constant from the back to the front of the substrate 231 is 11.2 msec. The sliding coat layer 233 is made of glass and has a thickness of 30 μm. The thermal conductivity is 1.4 W/(m·K), the thermal capacity per unit area is 140 J/(K^2), and the time constant from the back to the front of the sliding coat layer 233 is 3.0 msec. The time constant τ from the heating element 234 to the front surface of the heater 23 is 16.2 msec in total. The wave number control is the same as that of the present embodiment, and the longest continuous electrification period tON and the longest continuous shutoff period tOFF are 60 msec. The longest continuous electrification period tON and the longest continuous shutoff period tOFF are greater than the time constant τ and 3.7 times the time constant τ.

Figure 10:
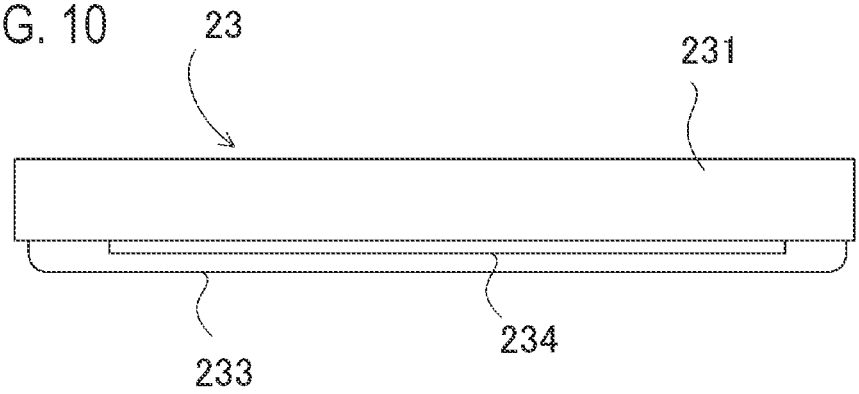
FIG. 10 is a diagram illustrating a schematic configuration of a heater of Experiment Apparatus D as a comparison example.

Experiment Apparatus D is Comparison Example 3 and includes an image forming apparatus and a fixing device F1 that differ in configuration from the present embodiment. The heater 23 of Experiment Apparatus D has a heating element 234 on the front side (the contact surface with the fixing film 22) of the substrate 231. The heating element 234 anad the surface of the heater 23 are covered with a glass sliding coat layer 233 having a thickness of 50 μm. FIG. 10 shows the schematic configuration of the heater of Experiment Apparatus D. The thermal conductivity is 1.4 W/(m·K), the thermal capacity per unit area is 140 J/(K·m^2), and the time constant τ from the heating element 234 to the front surface of the sliding coat layer 233 is 5.0 msec. The wave number control is the same as that of the present embodiment, and the longest continuous electrification period tON and the longest continuous shutoff period tOFF are 60 msec. The longest continuous electrification period tON and the longest continuous shutoff period tOFF are greater than the time constant τ and 12 times the time constant τ.

FIG. 11 shows the results of the experiments. Experiment Apparatuses A and B of the present embodiment did not cause gloss non-uniformity which is visibly perceived. Experiment Apparatuses C and D of comparison examples caused significant gloss non-uniformity.

As described above, the amplitude of the surface temperature of the heater 23 can be reduced even in wave number control by setting the longest continuous electrification period tON and the longest continuous shutoff period tOFF of the wave number control to be not more than the time constant τ of the heater 23. The reduced amplitude of the surface temperature of the heater 23 reduces the melting non-uniformity and gloss non-uniformity of the toner on paper resulting from the wave number control, regardless of the configuration, thermal capacity, and thermal conductivity of the fixing film 22. Favorable images are therefore obtained.

MODIFICATIONS

The present invention is not limited to the preferred embodiments described above, and various modifications and variations can be made within the scope of the invention. Examples of modifications are now described.

First Modification

The heater 23 of the present embodiment includes the heating element 234 arranged on the back side (the side opposite to the contact surface with the fixing film 22) of the substrate 231, but the heating element 234 and the heater front surface may be parts of an integral component. As long as the relations of the time constant τ to the longest continuous electrification period tON and the longest continuous shutoff period tOFF are within the range shown in the present embodiment, the same advantageous effect can be achieved regardless of the configuration and material of the heater 23.

Second Modification

Figure 12:
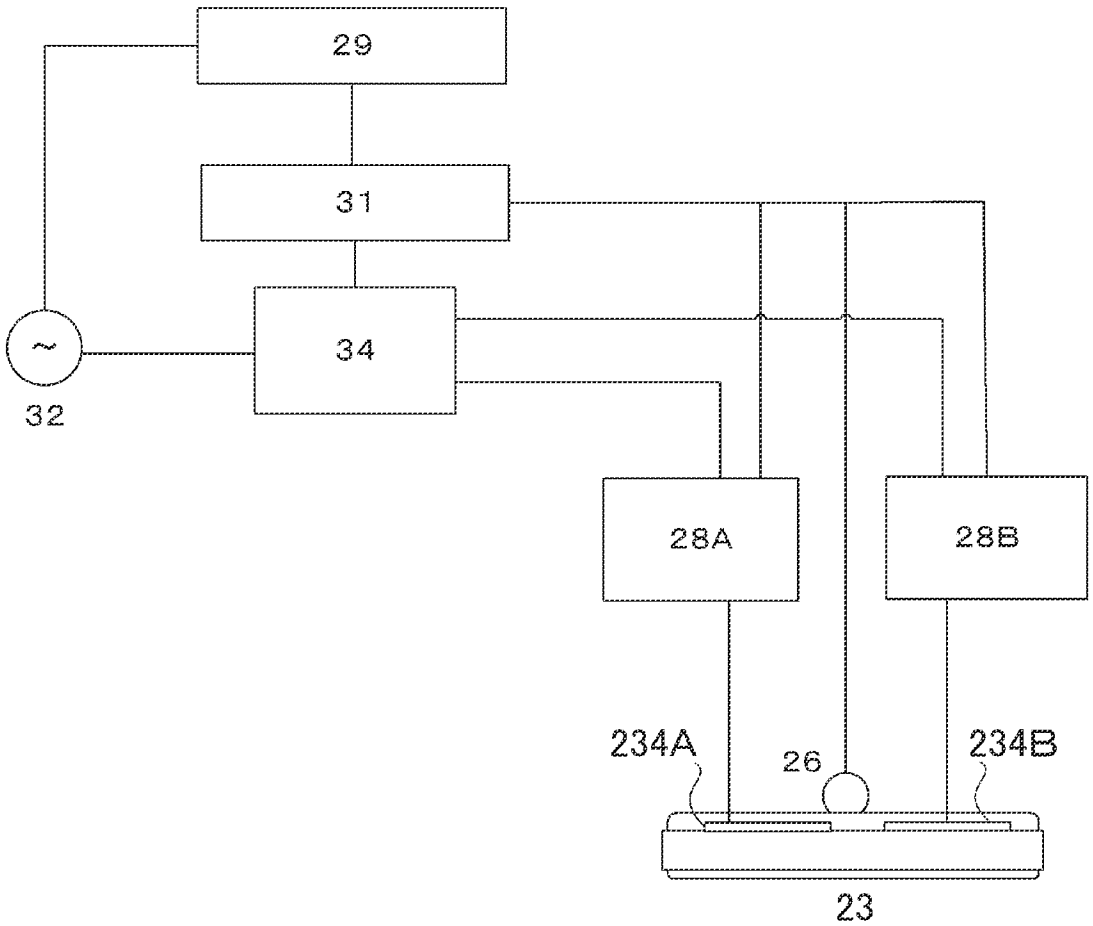
FIG. 12 is a schematic configuration diagram of a heater and a drive circuit of a second modification.

An image forming apparatus to which the present invention is applied may have a similar configuration as the first embodiment and also include a plurality of heating elements 234A and 234B capable of independently driving the heater 23. FIG. 12 shows a schematic configuration diagram of the heater 23 and the drive circuit of this modification. The elongated heating elements 234 extend in the longitudinal direction of the heater 23 and are arranged in the transverse direction of the heater 23 to be driven independently and not simultaneously. A control means 31 controls a relay 34 to switch connection from a commercial AC power supply 32 to a triac 28A and a triac 28B. The heating element 234A, which is driven by the triac 28A, and the heating element 234B, which is driven by the triac 28B, are each controlled by wave number control as in the first embodiment. The switching between the heating element 234A and the heating element 234B may be performed continually. As in the first embodiment, setting the longest continuous electrification period tON and the longest continuous shutoff period tOFF in wave number control to be not more than the time constant τ of the heater 23 achieves the same advantageous effect.

Third Modification

Figure 13:
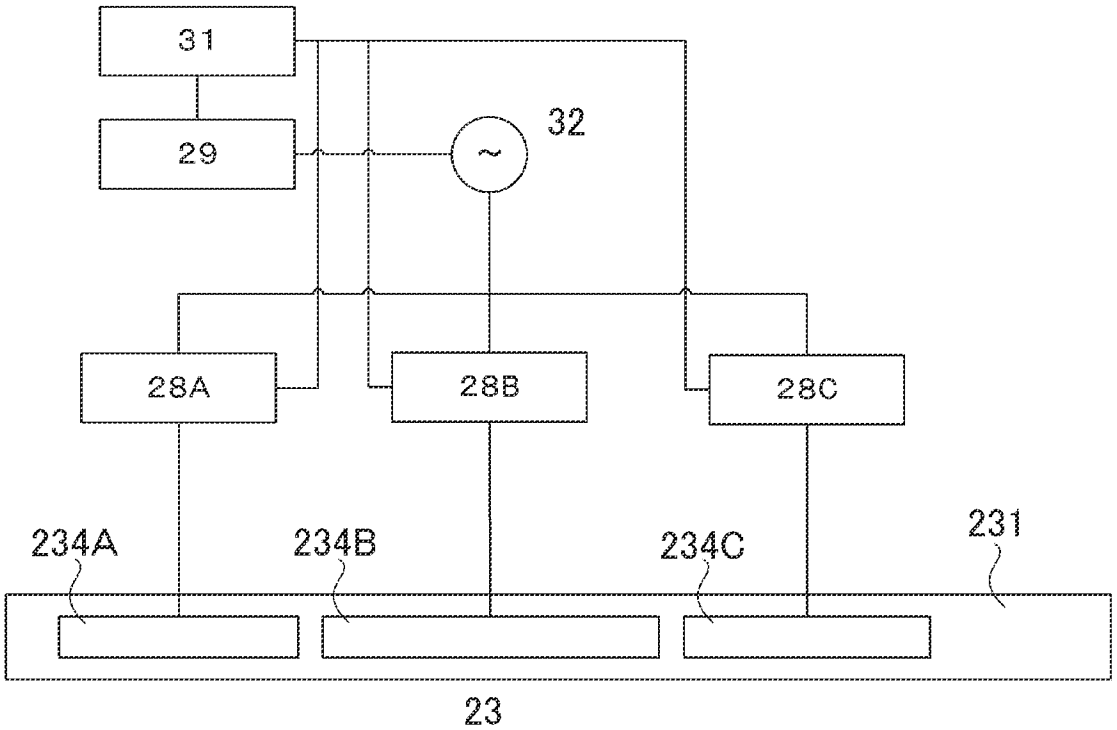
FIG. 13 is a schematic configuration diagram of a heater in a third modification.

An image forming apparatus to which the present invention is applied may have a similar configuration as the first embodiment and also include a plurality of heating elements 234A, 234B, and 234C capable of independently driving the heater 23 in the longitudinal direction. FIG. 13 shows a schematic configuration diagram of the heater 23 of this modification in the longitudinal direction. The heating elements 234 are arranged in the longitudinal direction of the heater 23 and independently driven by separate triacs. Similar to the first embodiment, each heating element is controlled by wave number control. Wave number control is performed for each heating element 234 at different timings. In the corresponding region, each heating element 234 can cause fluctuations of the surface temperature of the heater 23 and the melting non uniformity of the toner image G on the recording material passing through the region. As in the first embodiment, setting the longest continuous electrification period tON and the longest continuous shutoff period tOFF to be less than the time constant τ of the heater 23 achieves the same advantageous effect.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2021-038157, filed on Mar. 10, 2021, which is hereby incorporated by reference herein in its entirety.

What is claimed is:

1. An image heating device comprising:
a heater that includes a heating resistor and is configured to heat an image formed on a recording material;
a rotatable tubular film in which the heater is provided in an inner space of the rotatable tubular film;
a roller forming a nip portion between the roller and the film to transport the recording material; and
an electrification control portion configured to perform wave number control by changing a ratio of electrification ON to electrification OFF for each set control cycle,
wherein relations tON≤τ and tOFF≤τ are satisfied, where tON represents a longest continuous electrification period that is a longest period in which electrification is continuously on in electrification patterns in which electrification is turned both on and off in the control cycle, tOFF represents a longest continuous shutoff period that is a longest period in which electrification is continuously off in the electrification patterns, and τ represents a time constant of thermal conduction with a shortest distance from the heating resistor to a contact surface of the heater that is in contact with the film.

2. The image heating device according to claim 1,
wherein the heater includes, between the heating resistor and the contact surface with the film, a substrate on which the heating resistor is placed and a coat layer in contact with the film; and
wherein the time constant τ is a sum of a time constant of the substrate and a time constant of the coat layer.

3. The image heating device according to claim 2, wherein the substrate and the coat layer have time constants that are proportional to respective thicknesses thereof and thermal capacities thereof and inversely proportional to respective thermal conductivities thereof.

4. The image heating device according to claim 1, wherein the film has two layers of a base layer and a releasing layer having high releasability.

5. The image heating device according to claim 1, wherein the film has an overall thickness of not more than 160 μm.

6. The image heating device according to claim 1, wherein the time constant τ is at least 50 msec and less than 200 msec.

7. The image heating device according to claim 1, wherein the film is configured to thermally fix an image including toners of a plurality of colors formed on a recording material.

8. The image heating device according to claim 1, wherein the heater includes plural heating resistors arranged in a longitudinal direction perpendicular to a transport direction of the recording material, and the heating resistors are independently controlled.

9. The image heating device according to claim 1
wherein the rotatable tubular film is pinched by the heater and the roller, and
wherein an image on the recording material is heated through the rotatable tubular film at the nip portion formed between the rotatable tubular film and the roller.

10. An image forming apparatus comprising:
an image forming portion configured to form an image on a recording material; and
a fixing portion configured to fix the image formed on the recording material,
the fixing portion including:
a heater that includes a heating resistor and is configured to heat the image formed on the recording material;
a rotatable tubular film having an inner surface in contact with the heater;
a roller forming a nip portion between the roller and the film to transport the recording material; and
an electrification control portion configured to perform wave number control by changing a ratio of electrification ON to electrification OFF for each set control cycle,
wherein relations tON≤τ and tOFF≤τ are satisfied, where tON represents a longest continuous electrification period that is a longest period in which electrification is continuously on in electrification patterns in which electrification is turned both on and off in the control cycle, tOFF represents a longest continuous shutoff period that is a longest period in which electrification is continuously off in the electrification patterns, and τ represents a time constant of thermal conduction with a shortest distance from the heating resistor to a contact surface of the heater that is in contact with the film.

* * * * *